US005954507A

United States Patent [19]

Rod et al.

[11] Patent Number: 5,954,507

[45] **Date of Patent: *Sep. 21, 1999**

[54] METHOD AND APPARATUS FOR TRAINING A SHOOTER OF A FIREARM

[75] Inventors: Samuel R. Rod, Reston, Va.; Jon Allen Massey, Monrovia, Md.

[73] Assignee: Bristlecone Corporation, Reston, Va.

[ * ] Notice: This patent is subject to a terminal disclaimer.

[21] Appl. No.: 09/064,721

[22] Filed: Apr. 23, 1998

Related U.S. Application Data

[63] Continuation-in-part of application No. 08/718,130, Sep. 18, 1996.

[51] Int. Cl.[6] ..... F41G 3/26; F41A 19/09

[52] U.S. Cl. ..... 434/19; 89/27.3; 89/41.05; 89/136; 42/84

[58] Field of Search ..... 434/11, 16, 19–23; 89/27.3, 41.05, 136; 42/84

[56] References Cited

U.S. PATENT DOCUMENTS

| | | | |
|---|---|---|---|
| 1,875,941 | 9/1932 | Schwartz | 42/84 |
| 3,798,796 | 3/1974 | Stauff et al. . | |
| 3,828,458 | 8/1974 | Skone-Palmer | 89/27.3 |
| 4,256,013 | 3/1981 | Quitadama | 89/27.3 |
| 4,516,157 | 5/1985 | Campbell . | |
| 4,534,735 | 8/1985 | Allard et al. . | |
| 4,884,137 | 11/1989 | Hanson et al. . | |
| 5,599,187 | 2/1997 | Mesiano . | |

OTHER PUBLICATIONS

Brochure entitled "Proptts System", a Portable, Remotely Operated Police Tactical Training Simulator, Mesiano Manufacturing, Inc., West Berlin, New Jersey 08091, Feb., 1997.

Brochure entitled "The Mobile Assistant", a Voice–Activated Wearable Computer System, Xybernaut Corporation.

"*Mobile Assistant MAS–2000 Belt–worn Computer*", Zybernaut Corporation, 1996.

The "*i Virtual glasses!*" User's Guide, Virtual I.O. Inc., Aug., 1995.

Brochure entitled "*Aimpoint—Any Other Sight Is Pointless*", Dec., 1996.

*A Remote Viewing System for Firearms Training*, Samuel R. Rod, Bristecone Report #BETC–9605, Jan., 1997.

*Firearms Training Video System*, Bristlecone Corporation, Shot Shot '97 "Show Special" Prices, Jan., 1997.

*Firearms Training Video System*, Bristlecone Corporation, FTVS portable unit carrying case, Jan., 1997.

*Firearms Training Video System*, Bristlecone Corporation, FTVS indoor range unit, Jan., 1997.

*Firearms Training Video System*, Bristlecone Corporation, FTVS portable unit, Jan., 1997.

*Testing Of A Remotely Operated Firearm And Its Sighting System*, Bristolecone Report # BETC–9702, pp. 1–4, Jun., 1997.

User's Guide for TASCO NV–118 Night Vision Scope, which is representative of prior art IR Vision System.

*Primary Examiner*—John Mulcahy

*Attorney, Agent, or Firm*—Burns, Doane, Swecker & Mathis L.L.P.

[57] ABSTRACT

A process and apparatus for training a shooter are disclosed which includes a video camera system for displaying images used by the shooter in aiming the firearm and/or a remotely controlled trigger actuator.

8 Claims, 8 Drawing Sheets

METHOD AND APPARATUS FOR TRAINING A SHOOTER OF A FIREARM

RELATED APPLICATIONS

This application is a continuation-in-part of application Ser. No. 08/718,130 filed Sep. 18, 1996.

FIELD OF THE INVENTION

The present invention relates to methods and apparatus for training or instructing in the use of a weapon, firearm or other optically aimed device.

BACKGROUND OF THE INVENTION

Instruction in the proper use of firearms is an important part of the training of military and law enforcement personnel. It is also of interest to sportsmen, particularly instruction which promotes safer use of firearms in recreational settings.

In conventional firearm training, the student is instructed as to the proper stance, aiming and firing of the firearm. This may involve firing in various positions or while moving with respect to the target. Accuracy can be determined by examining the location of bullet holes in the target. Some students, however, have difficulty developing the skills necessary to properly position the firearm through aiming, the squeezing of the trigger and the follow-through. These difficulties greatly increase instructional costs and may prevent otherwise well-qualified candidates from entering some military or law enforcement services.

SUMMARY OF INVENTION AND OBJECTS

The present invention is based, in part, on the discovery that effective training of a shooter can be achieved by reproducing for an instructor and student essentially exactly what the shooter sees from the moment the shooter begins to align the firearm sights, through the instant of firing and the follow-through. With the aid of the disclosed techniques, the shooter can be trained to reproduce certain geometries in aiming and firing the firearm. Both student and instructor have the benefit of the same image or line of sight and may share the same live view. Particular images obtained during aiming and firing may be replayed or correlated with success or failure in hitting the target. In this way a shooter's weakness and bad habits may be analyzed and corrected.

The invention is also based on the recognition that a video camera may be used in conjunction with certain red dot sights to provide instructional information through aiming, the instant of firing and the follow-through.

Further, the invention is based on the discovery that effective training of a shooter may be achieved using a remotely controlled trigger actuator, preferably in conjunction with a video camera system for producing a video signal approximating the shooter's view in sighting the firearm.

The present invention includes a process for training a shooter in the aiming of firearms. In the process, a firearm is provided with a remotely controlled trigger actuator. A video camera is positioned approximately parallel to a direct line of sight of the shooter. A firearm including the one provided with the trigger actuator is fired multiple times. In at least one firing the firearm is both sighted and manually fired by the shooter and, in at least another instance, the firearm is sighted by the shooter, but fired by remote control of the trigger actuator. Video signals are displayed of the shooter's view of the multiple times of firing to identify movements of the firearm caused by manual actuation of the trigger.

In a preferred embodiment of the present invention, a video camera may be positioned on a set of video display eyewear worn by the shooter. The video camera provides a video signal which is displayed to at least one of the shooter's eyes in the eyewear as a substitute for a view in the direct line of sight of the shooter. The shooter uses the displayed image from the eyewear to sight the firearm. The firearm is fired and the result of the firing is correlated with the displayed video signal. In other preferred embodiments, the video signal may be recorded and played back for the shooter and/or the instructor. In another embodiment, the video signal from the head-mounted camera is superimposed on either a view of the results of the firing of the firearm or the view from a tripod-mounted camera positioned so as to record the image of the shooter's hand, arm or body during firing of the firearm.

The present invention also relates to an apparatus for training a shooter of a firearm. The apparatus may include a trigger actuator adapted to be removably attached to the firearm, while permitting the shooter to grip and sight the firearm. A controller is provided for remotely controlling the trigger actuator to fire the firearm after it has been aimed by the shooter thereby eliminating jerk and recoil anticipation effects. The actuator is used to assist the shooter in identifying and controlling these effects. A video camera, advantageously one located on the firearm or head of the shooter, is oriented to receive a view approximately the same as the view of the shooter during aiming and firing of the firearm. A video display is employed to reproduce the view of the shooter during aiming and firing of the firearm, both manually and by remote actuation.

In more preferred embodiments, the trigger actuator is capable of producing a variety of trigger movements and pressures including those adapted for single and double action triggers. The trigger actuator may include a bracket for attachment to the firearm, a motor, a traveling member for engaging the trigger, and a linear screw drive for moving the traveling member against and away from the trigger of the firearm.

In other preferred embodiments, the video camera is pivotably mounted on the eyewear so that the input optical axis of the video camera is selectively positionable with respect to the head of the shooter. This selectively positionable feature permits the optical input axis of the camera to be aligned with a line of sight of either the left or the right eye of the shooter. The vertical elevation of the optical input axis may be varied, and the angle with respect to the plane of the face of the shooter may be varied as well. In this way, the optical axis of the camera may be selectively positioned with respect to the eyewear to permit the shooter to shoot comfortably with either or both eyes open and in various postures.

In another embodiment of the present invention the eyewear is binocular video eyewear with separate flat panel video displays for the left eye and the right eye. In yet a further embodiment, the video camera is selectively focusable to replicate the focus and focus depth normally used by the shooter in aiming the firearm.

Another preferred embodiment of the present invention is an apparatus for training a shooter of a firearm equipped with red dot optical sight. The apparatus includes a video camera having a view of the visual indicator produced by the red dot optical sight and for producing a video signal approximately the shooter's view through the sight. In situations where the red dot optical sight has acceptable parallax off-axis, a bracket may be used for attaching the video camera to the optical sight at an off-axis location which does not appreciably obstruct the shooter's view through the sight.

It is an object of the present invention to provide methods and apparatus for effectively training individuals in optical aiming, particularly of firearms.

It is a further object of the present invention to aid a shooter and instructor in making efficient use of training time both on the firing range and in the classroom.

It is a further object of the present invention to permit a firearm instructor and shooter to share the same line of sight and view from the moment the shooter begins to align the firearm's sight through the instant of firing and the follow-through.

It is a further object of the present invention to provide a remotely controlled trigger actuator, to identify unwanted movement caused by the shooter's manual actuation of the trigger.

It is a further object of the present invention to provide training apparatus which substitutes a reproducible, displayed image for a direct view of the target used in aiming.

It is a further object of the present invention to provide an eyewear-mounted video camera with an optical axis selectively positionable with respect to the eyewear, adapted to permit the shooter to shoot comfortably with either or both eyes open and in various postures.

It is a further object of the present invention to permit the view of the shooter to be displayed or redisplayed and correlated with the result of the firing of the firearm.

It is a further object of the present system to employ a video training apparatus easily used with a firearm equipped with a red dot sight.

It is a further object of the present invention to provide an aid to shooters, so that the shooter can learn to reproduce certain geometries associated with the accurate aiming and firing of a firearm.

These and other objects and features of the invention will be apparent from the following detailed description of the preferred embodiments.

DETAILED DESCRIPTION OF PREFERRED EMBODIMENTS

Various preferred embodiments of the present invention will now be described with reference to the drawings.

Figure 1:
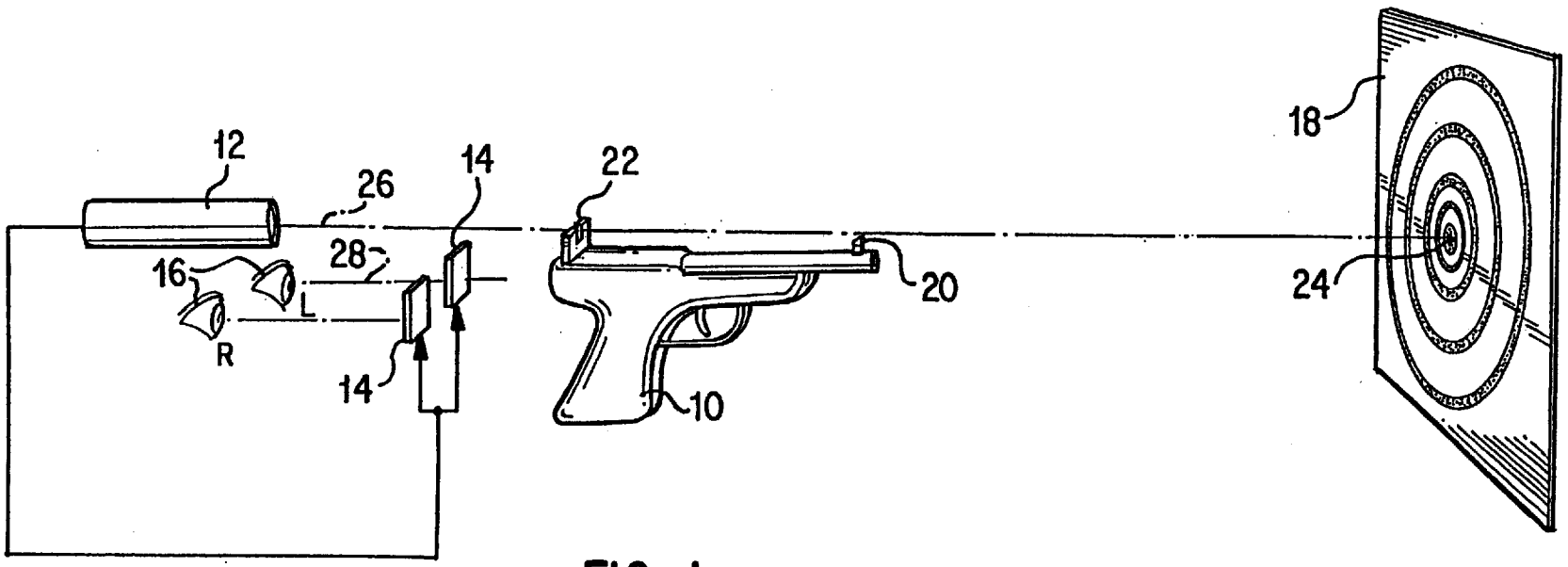
FIG. 1 is a perspective view of portions of an embodiment of the present invention illustrating certain geometrical relationships in the aiming of a firearm.

FIG. 1 is a perspective view of portions of an embodiment of the present invention illustrating certain geometrical relationships in the aiming of a firearm 10. The system includes a video camera 12 and one or more optical display panels 14 positioned in gear or goggles (not shown) worn by the shooter. The shooter's eyes are depicted at 16. A target 18 is located at a distance from the firearm 10. In FIG. 1, the target 18 is shown as the familiar bullseye firing range target. However, it should be understood that the word "target" is used herein to identify generally any object or image desired to be hit or aimed at.

Figure 1A:
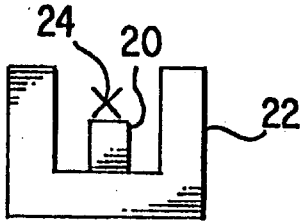
FIG 1*a* is a pictorial depiction of a view through the sight of the firearm shown in FIG. 1.

The firearm shown in the embodiment of FIG. 1 is equipped with a front sight 20 and a rear sight 22. In normal operation the shooter optically aligns the front sight, the rear sight and the point 24 of the target. FIG. 1*a* is a pictorial depiction of the view through the sight of the firearm shown in FIG. 1 when aiming is achieved. In this case a three-point alignment has been made between the front sight 20, the rear sight 22 and the point 24. While this embodiment is described with reference to this particular firearm sighting system, it will be readily understood that invention can be used with other optical sighting systems.

With continued reference to FIG. 1, the camera 12 is shown as having an optical input axis 26 which is positioned to approximate a typical or natural line of sight 28 of the shooter. The camera produces a video signal approximately representing the shooter's view at that line of sight. The video signal is applied to the one or more flat panel displays 14.

As shown in FIG. 1, the display 14 for the video signal substitutes for a direct field of view of the shooter's left eye. In this way the video camera simulates an aiming of the firearm done with the left eye. It will be understood that effective simulation requires positioning of the video camera to provide a displayed image approximating the view which the shooter would have in aiming, e.g. on the natural line of sight 28 of the shooter.

The view of the shooter obtained with the video camera can be displayed or redisplayed and correlated with the result of the firing of the firearm. These displays can provide aids to shooters and shooting instructors in learning to reproduce certain geometries associated with the accurate aiming of the firearm. The system allows the instructor to see virtually exactly what the shooter sees from the moment the shooter begins to align the firearm sight, through the instant of firing and the follow through.

Figure 2:
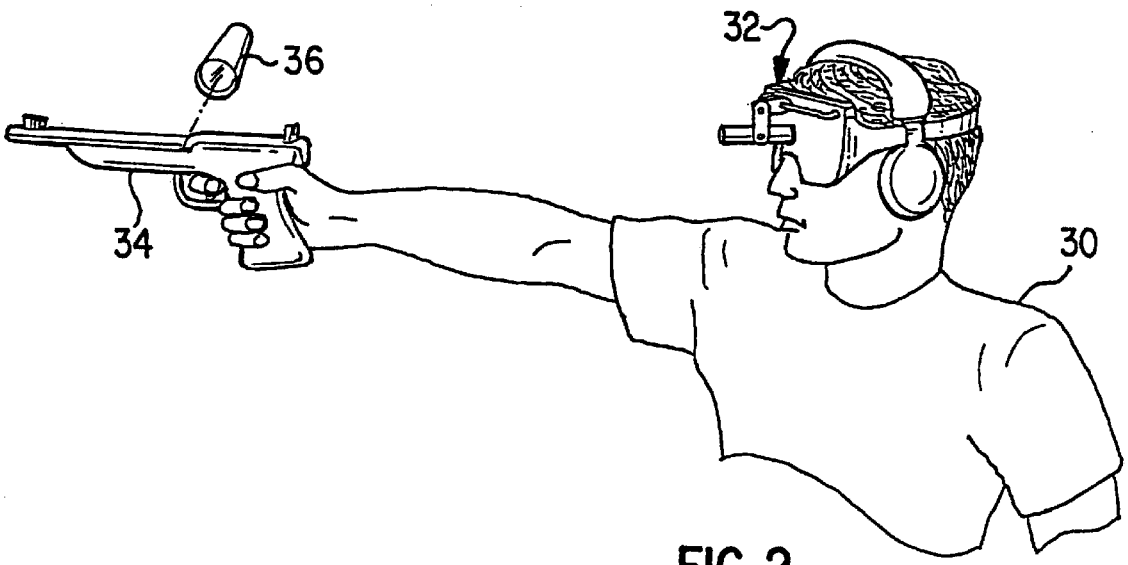
FIG. 2 is a pictorial view of a shooter equipped with an embodiment of the training apparatus of the present invention.

FIG. 2 is a pictorial view of a shooter equipped with an embodiment 22 of the apparatus of the present invention. In the Figure the shooter 30 is shown wearing eyewear 32 and aiming the firearm 34 in a standing position, though the system is adaptable to use in other firing postures. The firearm 34 may be equipped with any conventional optical sight including the optical sight shown and described in connection with FIG. 1 or a conventional laser red dot optical sight. Implementations of the invention with a red dot sight are discussed in greater detail below in connection with FIGS. 5 and 5*a*.

FIG. 2 also shows an optional side view camera 36 for obtaining side images of the aiming and firing of the firearm which may be employed in the overall training system as described in greater detail below.

Figure 2A:
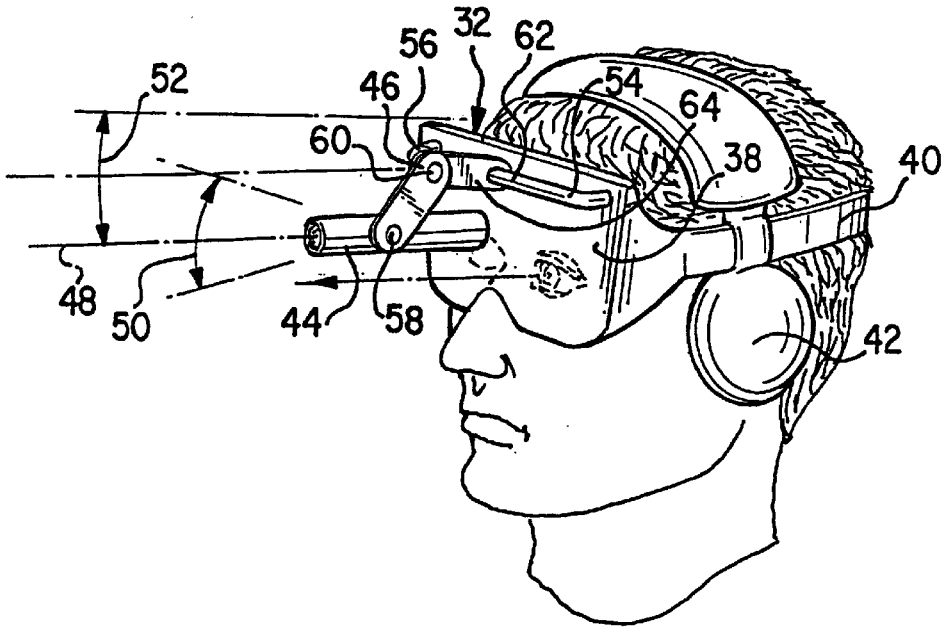
FIG. 2*a* is a detail of the eyewear embodiment shown in FIG. 2 illustrating the selectively positionable components of a camera mount.

FIG. 2*a* is a detail of the eyewear and camera embodiment of the present invention shown in FIG. 2. The eyewear 32 may include a high resolution binocular video display 38 held in position on the head of the shooter by a band 40. A suitable display system is sold under the trademark VIRTUAL I-GLASSES manufactured by Virtual I.O. Inc. Normally, shooters aim using one eye with the other eye closed. However, images may be displayed to both eyes, and if desired, the images may be stereoscopic.

In a preferred embodiment, the eyewear may be equipped with optional ear protectors. Earphones 42 may provide both protection and audio communication from the instructor.

A video camera 44 is mounted on the eyewear 32. Advantageously, the camera may be of the miniature high resolution variety, for example, a 7 mm CCD camera with 120,000 to 180,000 pixel resolution producing 60 fields or 30 frames per second. Associated control and power circuitry for the camera (not shown) may be worn on the body of the shooter. Also, advantageously the camera may be provided with means for adjusting the focus and focusing depth of the camera, so that the image displayed to the shooter replicates the natural focus and focusing depth of the shooter when using the unaided eye to aim the firearm. A video output signal from the camera may be applied to LCD display panel or panels in the eyewear 32 and also be provided to other associated circuitry and displays described in greater detail in connection with FIG. 3.

With continued reference to FIG. 2(*a*), the camera 44 is shown attached to the eyewear 32 by a camera mount 46. The camera mount 46 facilitates the selective positioning of the optical axis 48 of camera 44 to conform with the shooter's choice of eye and posture in aiming the firearm. In the position shown in FIG. 2*a,* the camera is shown in a position which would replicate a typical direct line of sight for both left and right eyes for a standing shooter. However, the camera and its optical axis 48 can be repositioned in several different ways. First, the optical axis can be repositioned at different angles with respect to the face of the shooter as indicated by the double headed arrow 50. The elevation of the optical axis 48 can be repositioned through a range of elevations indicated by the double headed arrow 52. Finally, the camera mount 46 can be relocated to a left position 54 or a right position 56 to more accurately approximate the natural line of sight of the shooter using his left eye or right eye, respectively. In the embodiment shown in FIG. 2*a* the selected positioning of the optical axis 48 is accomplished by use of pivoting pins 58 and 60 and a slide rod 62 releasably engaged to the camera mount at 64. In use the camera mount can be slid to any position between the ends of the rod 62 to approximate the natural line of sight of the left eye, right eye or a combination of both. Alternatively, releasable fasteners and corresponding mounting holes on the eyewear (not shown) may be employed to change the location of the camera on the eyewear. An alternative mounting device is described in connection with FIG. 4 below.

Figure 3:
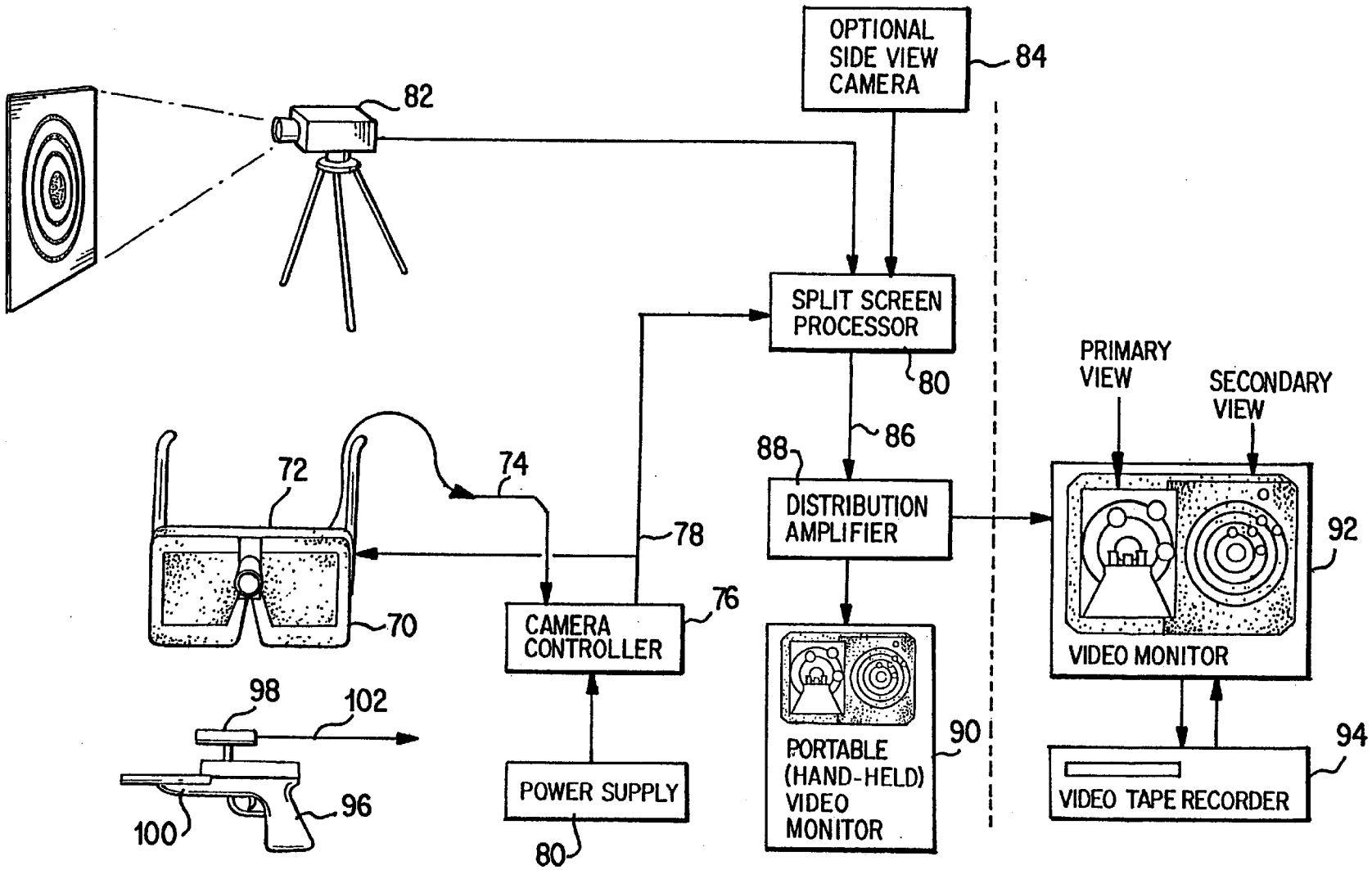
FIG. 3 is a schematic block diagram of system embodiments of the present invention, illustrating certain aspects of image processing and display.

FIG. 3 is a schematic block diagram of a system embodiment of the present invention illustrating certain useful image processing and display techniques. The principle components of the system illustrated in FIG. 3 are the camera and display eyewear 70 and display monitors for use by the shooter and/or the instructor. In the system of FIG. 3 a head mounted camera 72 with an optical axis approximately parallel to a direct line of sight of the shooter provides a video signal 74 to a camera controller 76. The camera controller 76, in turn, provides a video signal 78 back to the eyewear 70 where it is displayed to one or more eyes of the shooter during aiming and firing of the firearm. The camera controller 76 is also equipped with a power supply 80. Both the camera controller 76 and power supply 80 may be worn by the shooter, for example, as an integrated belt mounted unit with video signal cabling running to the eyewear 70.

The video output signal 78 of the camera controller 76 may also be applied to a conventional split screen processor 80. Optionally, the split screen processor may receive signals from a target camera 82 focused on the target to view the results of the firing, or from an optional side view camera 84 such as that also shown in FIG. 2. An output signal 86 from the split screen processor may be applied to a distribution amplifier 88 which in turn provides signals for additional displays of the view through the camera 72 as well as (optionally) for views from the target camera 82 or the side view camera 84. Output signals of the distribution amplifier 88 may, for example, be applied to a portable hand-held video monitor 90, such as a WATCHMAN television display used at the target range. Alternatively or in addition, an output signal from the distribution amplifier 88 may be applied to a larger video monitor 92 used in a control booth or classroom by students and instructors.

The system may also include a videotape recorder 94 for replaying video images of the various views obtained by the cameras in the system. The recorded video signal may, for example, be played back and displayed on the portable hand-held video monitor 90, on the larger video monitor 92 in a control booth or classroom or on the display panels of the eyewear 70.

An alternative camera system 96 is also illustrated in FIG. 3. In this system a rail mounted camera 98 is attached to firearm 100 and provides a video signal 102 to the camera controller 76.

In FIG. 3 there is also illustrated examples of views which may be displayed to correlate the images used by the shooter in aiming the firearm with the results of the firing of the firearm. For example, the video monitors 90 and 92 are shown with a split screen display comprising a primary view and a secondary view. The primary view is a display of the video signal corresponding to the display used by the shooter in actually aiming and firing the firearm. The secondary view is a close-up view obtained from the target camera 82 which shows the results of the firing. With the aid of the video tape recorder 94, instantaneous or delayed stop action viewing may be obtained. With the use of the target camera 82 and the split screen display, the instructor can instantaneously see how well the shooter performs and make on-the-spot suggestions for improvement. The shooter's weaknesses and bad habits can be minimized or eliminated, and strengths positively reinforced by use of the described systems.

Figure 4:
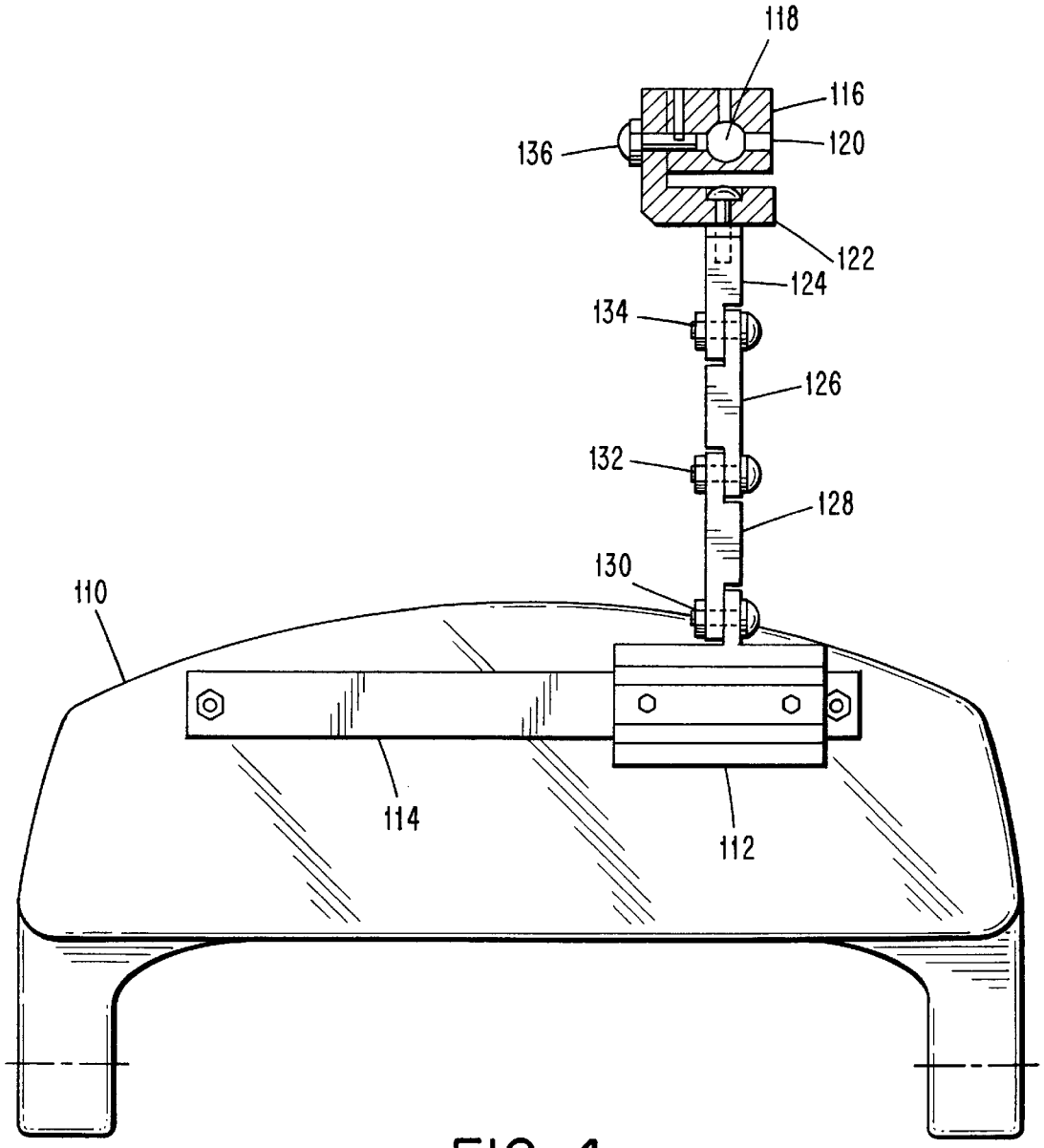
FIG. 4 is a front view of an alternative embodiment of a selectively positionally camera mount.

FIG. 4 is a front view of an alternative camera mounting mechanism. Numeral 110 identifies a frame portion of the shooter's goggles. A sliding bracket 112 is attached to a rail 114 mounted on the frame portion 110. A miniature video camera may be located in a camera mounting block 116, in aperture 118. A ball plunger 120 may be used to retain the camera in the mounting block.

The mounting block is supported by series of pivoting arms 122 through 128. These arms are attached to one another at pivot points 130 through 134. The L-shaped arm 120 is pivotably attached in the camera mounting block 116 at pivot point 136.

In operation, the sliding bracket 112 can be moved horizontally along the rail 114 to provide the desired horizontal positioning of the camera. By pivoting the arms 122 through 128, the camera may be located at various elevations with respect to the goggles and the camera rotated to various angles with respect to the goggles and supporting arms.

Figure 5:
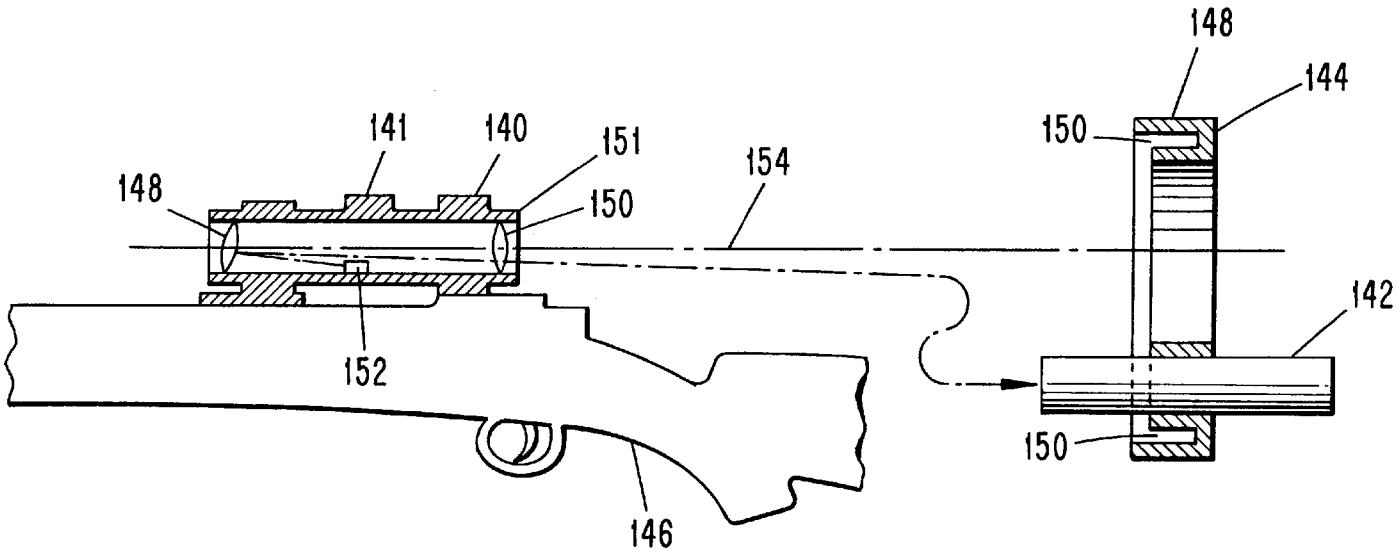
FIG. 5 is a cross-sectional side view of a red dot sight and a camera and mounting bracket for use therewith.

FIG. 5 is a cross-sectional side view of a red dot sight 140, video camera 142 and mounting bracket 144, the camera and mounting bracket being shown enlarged and disengaged from the sight.

The red dot sight 140 is shown having a tubular housing 141 attached to firearm 146. The red dot sight may include first and second lenses 148 and 150. A light emitting diode 152 may be provided to project a red spot on lens 148, which spot is then reflected onto lens 150. The shooter looks through the lens 150 to see the spot and a view of the target.

Typically, the shooter sights through the sight along optical axis 154. The spot is superimposed on the target at the point of predicted impact of the bullet. A suitable red dot sight of this type is provided by Aimpoint AB of Malmo, Sweden and sold under the trademark AIMPOINT. These sights employ a double lens system which is claimed to eliminate parallax deviation. In other words, the spot will appear superimposed on the target at the point of predicted impact, even when viewed off-axis by the shooter.

Figure 5A:
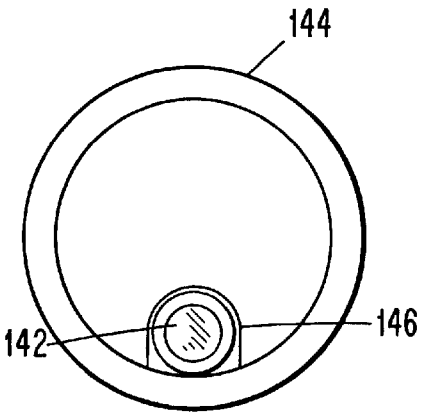
FIG. 5*a* is a front view of the camera mounting bracket of FIG. 5.

In preferred embodiments of the present invention, the bracket 144 is designed to position the video camera at an off-axis location which does not appreciably obstruct the shooter's view through the sight. Such positioning is best illustrated in FIG. 5*a,* which is a front view of the bracket and camera assembly of FIG. 5. As shown in FIG. 5*a,* the bracket includes a member 146 into which the camera is pressure fit to maintain the camera in position near the radial edge of the bracket. Advantageously, the bracket includes an attachment ring 148 with an annular groove 150 for releasably engaging a circular end position 151 of the tubular housing 141 of the red dot sight. In operation, the bracket and camera assembly can be fitted on the sight housing, and the camera used to produce a video display of the aiming of the firearm for use by the shooter or an instructor.

Figure 6:
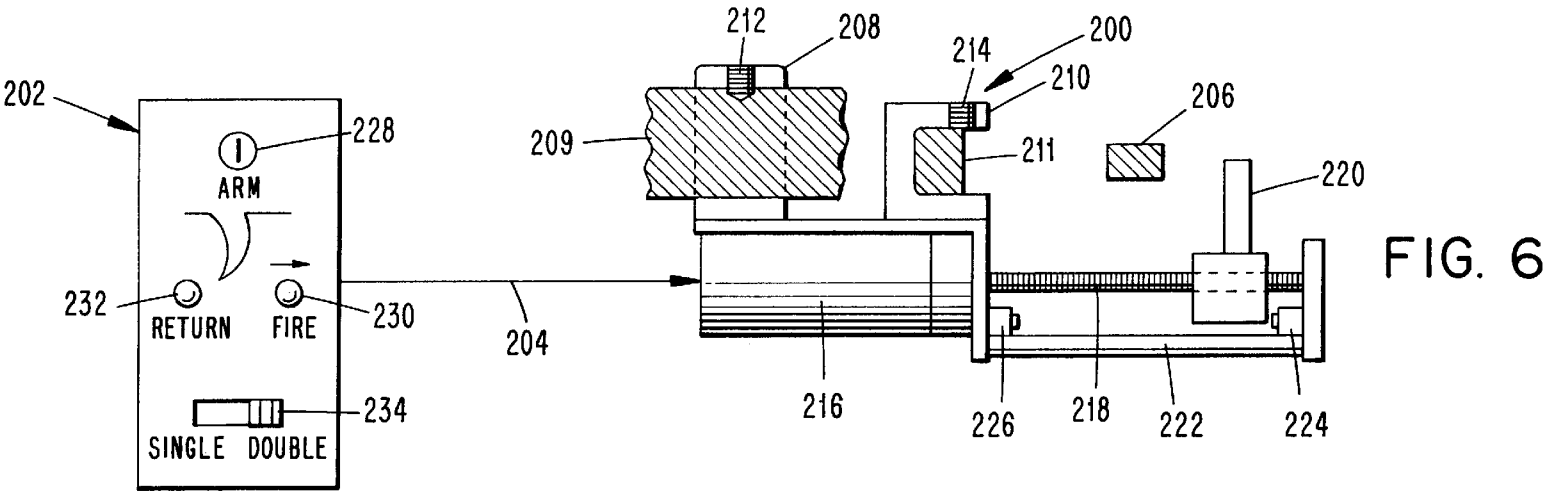
FIG. 6 is a depiction of a remotely controlled trigger actuator and a controller therefor and FIG. 6*a* is a side view of the trigger actuator of FIG. 6.

FIG. 6 is a depiction of a remotely controller trigger actuation 200 and its controller 202. These devices may be used in training shooters, either alone, or in conjunction with the video camera and display systems previously described.

In accordance with the present invention, a remotely operated firearm may be used as a training device that allows a firearms instructor to remotely fire a weapon while the trainee holding the weapon maintains proper stance, sight view and aim. The purpose of such an exercise is to demonstrate proper trigger control.

FIG. 6 shows the basic configuration for training: controller 202 used by the instructor and the actuator 200 mounted on the trainee's firearm, the two being linked by radio or dedicated controller line as indicated by the arrow 204. In the case of the former, for safety reasons, the system may use a two-channel radio transmitter and receiver. Both channels must receive a valid signal simultaneously for the weapon to fire. All traditional range safety protocols must also be followed.

The construction of a preferred embodiment of the trigger actuator 200 will be described in conjunction with FIGS. 6 (plan view) and 6*a* (side view). In FIG. 6 the trigger of the firearm is indicated by numeral 206. (Portions of the firearm are shown in cross section in FIG. 6 and are crosshatched.) The actuator may be removably clamped to the firearm by brackets 208 and 210, and locking screws 212 and 214. More specifically, bracket 208 may be clamped to gun frame portion 209 and bracket 210 clamped to trigger guard 211. A gear head motor 216 is provided to turn a linear screw drive 218 in both clockwise and counterclockwise directions. A traveling member 220 engages the screw drive and travels on rails 222. Micro-switches 224 and 226 are provided to detect the arrival of the traveling member 220 at the forward and rearward end points of its travel, respectively.

Figure 6A:
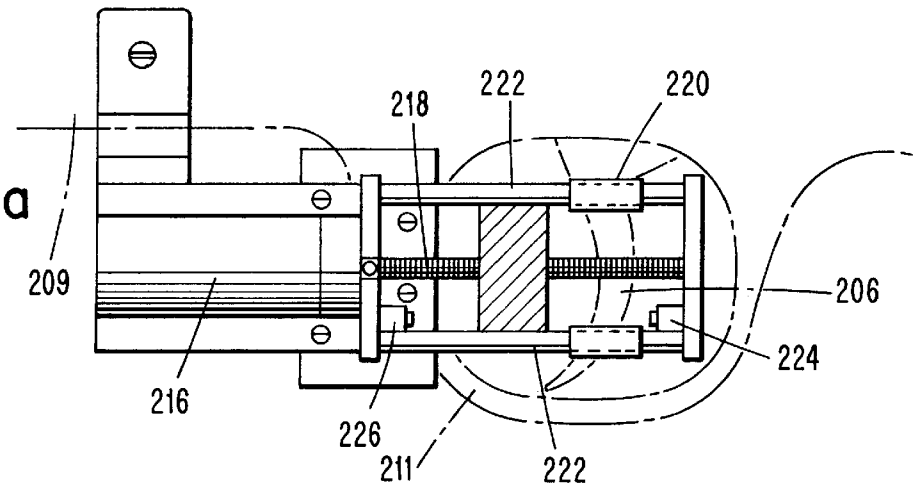

FIG. 6*a* is a side view of the trigger actuator of FIG. 6 wherein the frame 209, trigger guard 211 and trigger 206 of the firearm are shown in phantom.

The construction of a preferred embodiment of the remote controller 202 will now be described. In preferred embodiments, the controller is battery operator and contains the switches, logic and signal transmission circuitry for controlling the trigger actuator. Actuation of key locked switch 228 labeled "ARM" is required to enable the controller. A fire button 230, causes a firing signal to be sent to the actuator, which in turn, causes the motor 216 to rotate the screw drive 218 to move the traveling member 220 into engagement with the trigger. A return button 232 causes the traveling member to move in the opposite direction.

In preferred embodiments, the actuator is adapted to fire both single and double action firearms and to provide as much as 20 lbs. of trigger force. The drive system and logic of the controller may be adapted to different trigger pull regimens. In the embodiment shown in FIG. 6, a switch 234 is provided to select between single and double action firing.

In use, the trainee holds and sights his or her gun in the usual manner, but does not insert a finger into the trigger guard. When the instructor either sees through a video camera display or simply verbally checks with the trainee that he or she has a good sight picture or aim, the instructor actuates the trigger with the controller. The transmitter signal causes the gun's trigger actuator to fire the gun with no appreciable trigger jerk or torque on the gun during firing.

In practice, instructors may instruct problem shooters to shoot one magazine themselves, then redo the exercise with the trainee aiming, but the instructor firing with the remotely controller actuator. When the instructor actuates the trigger, the shot groupings are typically much smaller than the trainee's manual firings. This demonstrates that the trainee can aim well, but must learn to control undesirable trigger movement. Video camera systems of the type above described may be used to assist in identifying the undesired movements and in correcting them.

Figures 7, 7A:
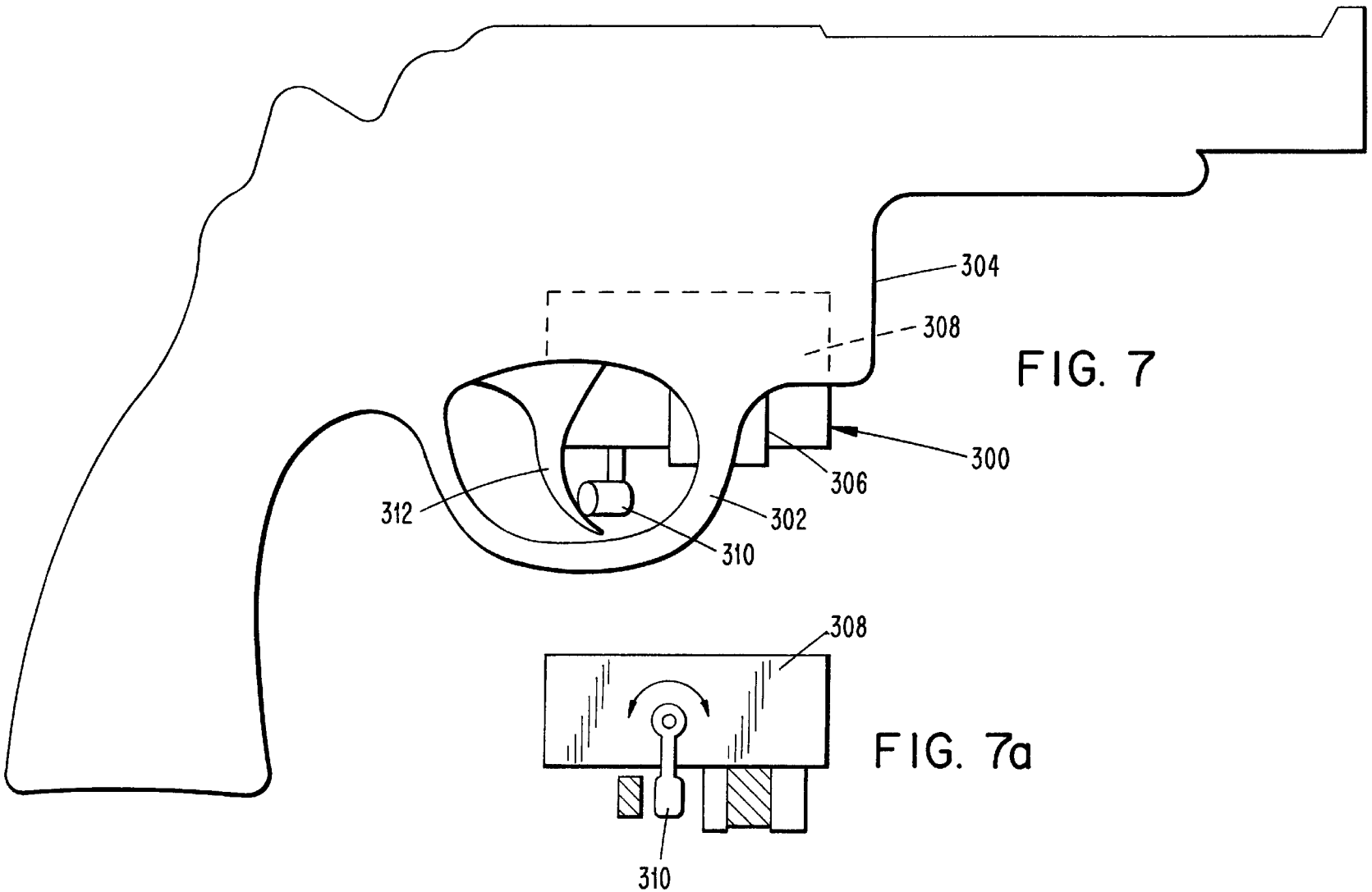
FIGS. 7 and 7*a* are depictions of a remotely controlled trigger and actuator with rotating arm.

FIG. 7 illustrates an alternative preferred embodiment of the trigger actuator of the present invention. The actuator 300 is shown attached to the trigger guard 302 of a pistol 304 by a bracket 306. The actuator includes a fast acting motor and gear drive assembly 308 which rotates a pivot arm 310 as illustrated in the plan view of FIG. 7*a*. The pivot arm contacts the trigger 312 as it pivots, but does not ride-up the curve of the trigger, thus simulating a smooth finger actuation of the trigger. As with the embodiment of FIG. 6, the actuator is provided with a remote controller communicating with the actuator by cable or radio link.

Figure 8:
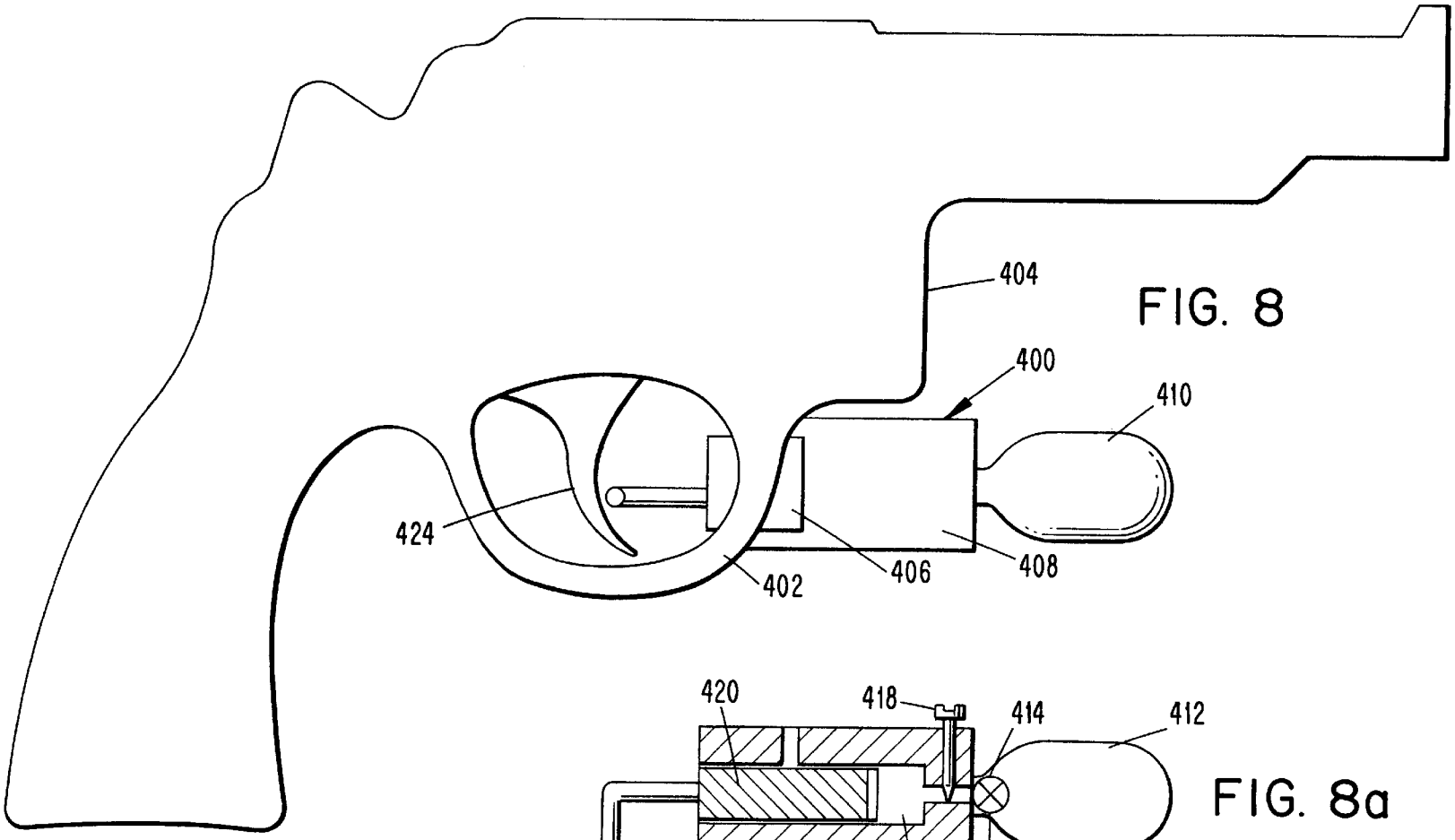
FIGS. 8 and 8*a* are depictions of a pneumatically operated, remotely controlled trigger actuator.

FIG. 8 illustrates a pneumatic trigger actuator of the present invention, adapted for use with a double action handgun requiring a light weight actuator capable of delivering a high trigger force (e.g. 10 to 20 pounds). The actuator 400 is shown attached to the trigger guard 402 of a pistol 404 by a bracket 406. The actuator includes a pneumatic valve 408 and a source of compressed gas 410. In FIG. 8 the source of compressed gas is shown as a Cq cartridge, it being understood that alternatively the source of compressed gas may be a remote reservoir connected to the valve by a conduit.

Figure 8A:
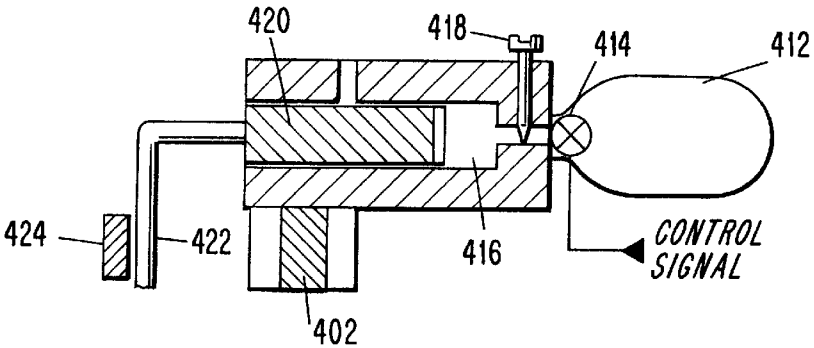

The operation of the actuator of FIG. 8, may be more readily understood with reference to the partial cross-sectional view of FIG. 8*a*. The $CO_2$ cartridge 412 provides compressed gas in response to the opening of solenoid valve 414 controlled by a remote controller (not shown). The compressed gas flows into cylinder 416 at a rate controlled by adjustment of needle valve 418. The timing of the actuator can thus be varied so that the shooter does not anticipate the firing. Compressed gas in the cylinder 416, moves piston 420 and attached arm 422 against the trigger 424, thereby simulating a smooth finger actuation of the trigger.

It will be appreciated that the disclosed trigger actuators are adapted for use on various handheld personal firearms such as pistols, rifles and shotguns, which are hand carried and normally fired by finger actuation of the firearm linkage to the firing mechanism.

It will also be appreciated that the actuator mechanisms described herein have small moment arms. In the embodiments described, the actuation forces are essentially balanced and contained between the trigger and trigger guard (or remainder of the gun) to minimize torque and jerk. The described actuators are also lightweight. The construction minimizes perturbations of the center of mass from that of the unequipped firearm, so that the remotely actuated firearm retains the same feel and reaction, as the unequipped firearm. The actuator essentially eliminates trigger jerk, and the trigger can be actuated without the trainee anticipating the firing. Thus, these sources of potential aiming errors can be eliminated for instructional purposes.

The invention herein has been described with reference to certain preferred embodiments. However, it should be understood that the scope of the invention is set out in the following claims and equivalents thereof recognized under law.

We claim:

1. A process for training a shooter of firearms with sights comprising the steps of providing a remotely controlled trigger actuator for a firearm;

fixing an input optical axis of a video camera with respect to the head of the shooter to approximate the natural direct line of sight of the shooter which would normally be used in sighting the firearm through its sight;

providing a video signal from the video camera:

firing a firearm multiple times wherein, in at least one firings a firearm is both sighted and manually fired by the shooter and wherein, in at least another instance, the firearm provided with the remotely controlled trigger actuator is sighted by the shooter and fired by remote control of the trigger actuator; and displaying the video signals of the shooter's view of the multiple times of firing to identify movements of the firearm caused by manual actuation of the trigger.

2. The process of claim 1, wherein the same firearm is used for the multiple firings.

3. The process of claim 1, wherein the video signal is recorded and displayed to the shooter to provide a visual comparison of manual and remote firing.

4. The process of claim 1, wherein an instructor views the displayed video signal and remotely controls the trigger actuator.

5. The process of claim 1, wherein the firearm is a handgun with an open sight.

6. The process of claim 1, wherein the actuator is removably attached to the firearm.

7. The process of claim 1, wherein the actuator applies a balanced force between the trigger and the remainder of the firearm to minimize actuator induced movement of the firearm during actuation.

8. The process of claim 1, wherein the video signal is displayed to at least one of the shooter's eyes as a substitute for the view in the direct line of sight of the shooter and such display is used for sighting a firearm when fired both manually and by controlled acutation.

* * * * *